US007696927B2

(12) United States Patent
Bae et al.

(10) Patent No.: US 7,696,927 B2
(45) Date of Patent: Apr. 13, 2010

(54) CAPACITIVE FEED ANTENNA

(75) Inventors: Charlie Bae, Seoul (KR); Haim Yona, Tiberias (IL); Snir Azulay, Tiberias (IL); Stefan Quantz, Tianjin (CN); Xiujuan Xu, Tianjin (CN); Xiao Da Tian, Yin Hai Li Wuxi (CN)

(73) Assignee: Galtronics Ltd., Tiberias (IL)

( * ) Notice: Subject to any disclaimer, the term of this patent is extended or adjusted under 35 U.S.C. 154(b) by 0 days.

(21) Appl. No.: 10/573,350

(22) PCT Filed: Mar. 12, 2006

(86) PCT No.: PCT/IL2006/000322

§ 371 (c)(1),
(2), (4) Date: Jul. 29, 2008

(87) PCT Pub. No.: WO2006/097918

PCT Pub. Date: Sep. 21, 2006

(65) Prior Publication Data

US 2008/0291111 A1 Nov. 27, 2008

Related U.S. Application Data

(60) Provisional application No. 60/661,750, filed on Mar. 15, 2005, provisional application No. 60/749,364, filed on Dec. 9, 2005.

(51) Int. Cl.
*H01Q 1/38* (2006.01)

(52) U.S. Cl. ..... 343/700 MS; 343/848

(58) Field of Classification Search ..... 343/700 MS, 343/846

See application file for complete search history.

(56) References Cited

U.S. PATENT DOCUMENTS 5,764,190 A 6/1998 Murch et al.

(Continued)

FOREIGN PATENT DOCUMENTS

GB 2 403 069 12/2004

(Continued)

OTHER PUBLICATIONS

Sanad M., "A compact dual-broadband microstrip antenna having both stacked and planar parasitic elements", IEEE Antennas and Propagation Society International Symposium 1996 Digest. Baltimore, Jul. 21-26, 1996.

(Continued)

*Primary Examiner*—Tan Ho
(74) *Attorney, Agent, or Firm*—Abelman, Frayne & Schwab

(57) ABSTRACT

The present invention seeks to provide an antenna having multiple radiating bands, including a ground plane, a feed plate extending generally parallel to and being spaced from the ground plane by a first distance and having a feed connection extending between the feed plate and the ground plane, at least one radiating element extending generally parallel to and being spaced from the feed plate by a second distance and at least one galvanic connector connecting the at least one radiating element at a first location on the at least one radiating element to the ground plane at a first location on the ground plane, the first location on the ground plane being separated from the feed connection by a third distance, the first, second and third distances being selected to achieve desired impedance matching of the feed plate, and the feed plate feeding the at least one radiating element at a location corresponding to an impedance substantially greater than 50 Ohm at least one band.

26 Claims, 4 Drawing Sheets

U.S. PATENT DOCUMENTS

| | | | | |
|---|---|---|---|---|
| 6,218,991 | B1 * | 4/2001 | Sanad | 343/700 MS |
| 6,593,887 | B2 * | 7/2003 | Luk et al. | 343/700 MS |
| 6,639,558 | B2 | 10/2003 | Kellerman et al. | |
| 6,650,294 | B2 | 11/2003 | Ying et al. | |
| 6,680,705 | B2 | 1/2004 | Tan et al. | |
| 6,795,028 | B2 * | 9/2004 | Stutzman et al. | 343/702 |
| 6,812,892 | B2 * | 11/2004 | Tai et al. | 343/700 MS |
| 7,053,844 | B2 | 5/2006 | Gaucher et al. | |
| 7,109,921 | B2 * | 9/2006 | Leelaratne | 343/700 MS |
| 7,136,019 | B2 | 11/2006 | Mikkola et al. | |
| 7,202,818 | B2 | 4/2007 | Anguera et al. | |
| 2002/0021248 | A1 | 2/2002 | Ying et al. | |
| 2005/0057409 | A1 | 3/2005 | Choo et al. | |
| 2005/0190106 | A1 | 9/2005 | Anguera et al. | |
| 2005/0195124 | A1 | 9/2005 | Baliarda et al. | |

FOREIGN PATENT DOCUMENTS

| | | |
|---|---|---|
| WO | WO 02/29929 | 4/2002 |
| WO | WO 02/078123 | 10/2002 |

OTHER PUBLICATIONS

U.S. Appl. No. 60/661,750, filed Mar. 15, 2005.
U.S. Appl. No. 60/749,364, filed Dec. 9, 2005.

* cited by examiner

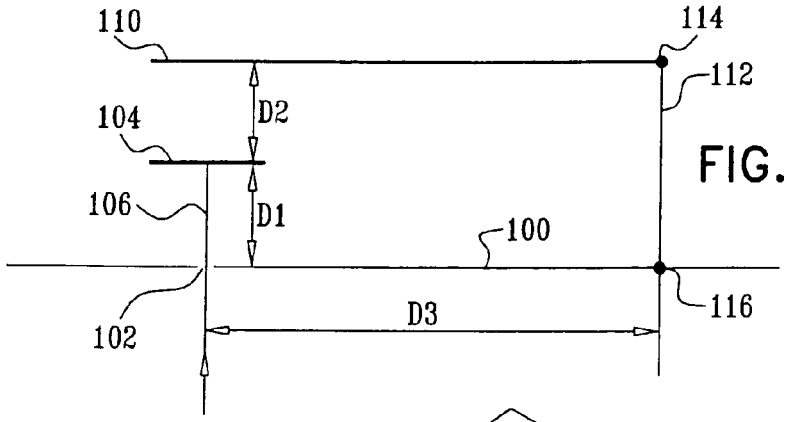
FIG. 1
FIG. 2A
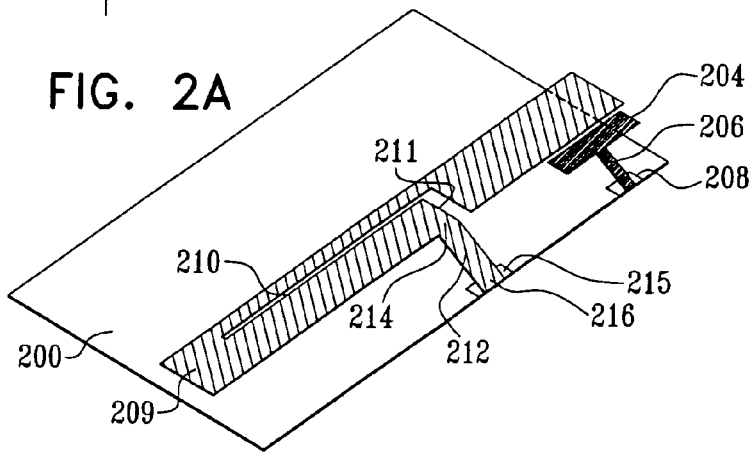
FIG. 2B
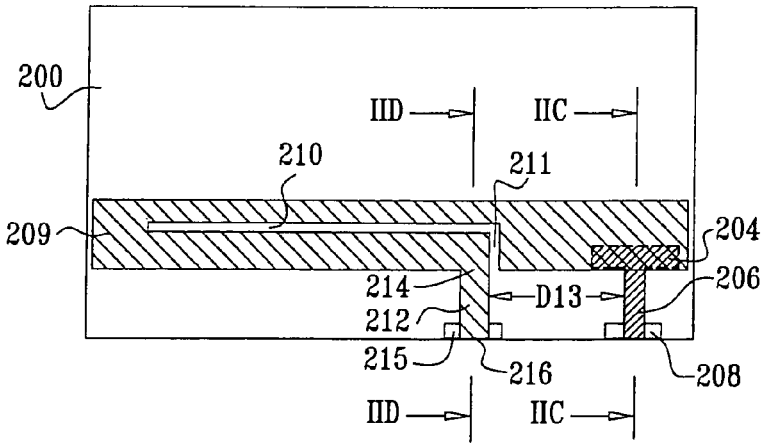
FIG. 2C
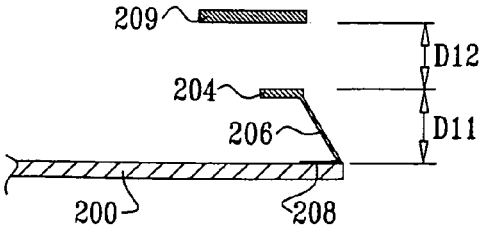
FIG. 2D
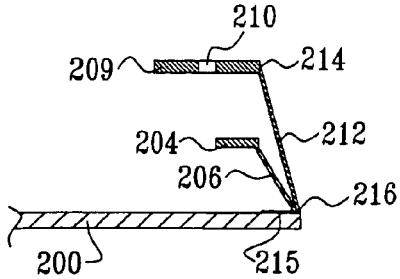

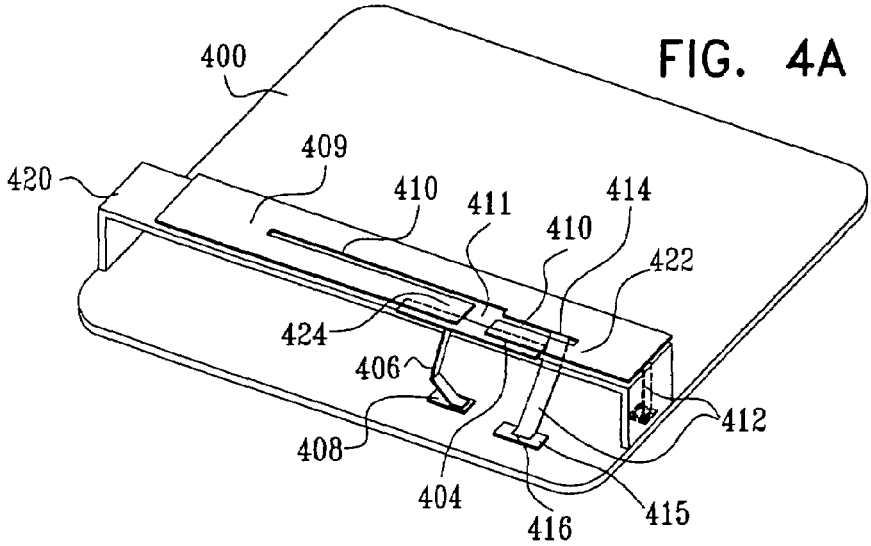
FIG. 4A
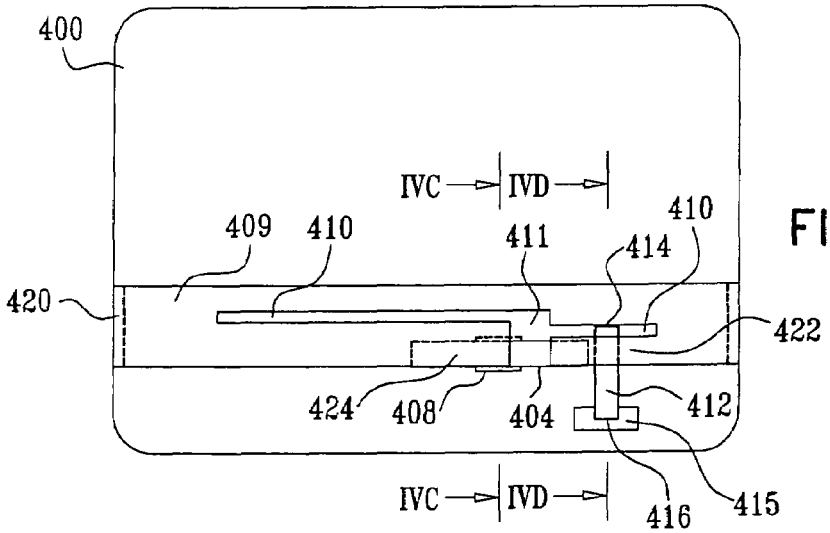
FIG. 4B
FIG. 4C
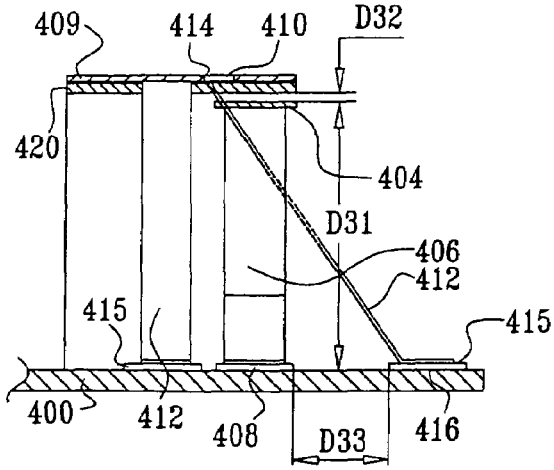
FIG. 4D
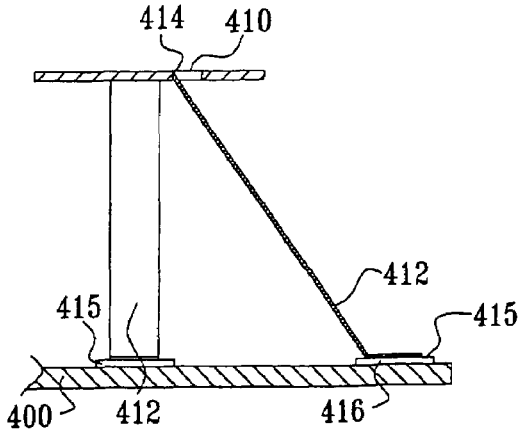

CAPACITIVE FEED ANTENNA

REFERENCE TO RELATED APPLICATIONS

The present application is related to U.S. Provisional Patent Application Ser. No. 60/661,750 filed Mar. 15, 2005, and entitled NON-CONTACT FEED FOR INTERNAL ANTENNA and U.S. Provisional Patent Application Ser. No. 60/749,364 filed Dec. 9, 2005 and entitled COMBINED CONTACT FEED FOR INTERNAL ANTENNA, the disclosures of which are hereby incorporated by reference and priority of which is hereby claimed pursuant to 37 CFR 1.78 (a) (4) and (5)(i).

FIELD OF THE INVENTION

The present invention relates to antennas generally and more particularly to antennas for mobile communicators.

BACKGROUND OF THE INVENTION

The following Patent documents are believed to represent the current state of the art:

U.S. Pat. Nos. 6,680,705 and 5,764,190; and

U.S. Published Patent Application No: 2005/0057409.

SUMMARY OF THE INVENTION

The present invention seeks to provide an improved antenna for use in a mobile communicator.

There is thus provided in accordance with a preferred embodiment of the present invention an antenna having multiple radiating bands, including a ground plane, a feed plate extending generally parallel to and being spaced from the ground plane by a first distance and having a feed connection extending between the feed plate and the ground plane, at least one radiating element extending generally parallel to and being spaced from the feed plate by a second distance and at least one galvanic connector connecting the at least one radiating element at a first location on the at least one radiating element to the ground plane at a first location on the ground plane, the first location on the ground plane being separated from the feed connection by a third distance, the first, second and third distances being selected to achieve desired impedance matching of the feed plate, and the feed plate feeding the at least one radiating element at a location corresponding to an impedance substantially greater than 50 Ohm at least one band.

In accordance with a preferred embodiment of the present invention the ground plane has an aperture formed therein, and the feed connection extends through the aperture.

There is also provided in accordance with another preferred embodiment of the present invention an antenna having multiple radiating bands including a ground plane, a feed plate extending generally parallel to and being spaced from the ground plane by a first distance and having a feed connection extending between the feed plate and the ground plane, at least one radiating element extending generally parallel to and being spaced from the feed plate by a second distance, at least one galvanic connector connecting the at least one radiating element at a first location on the at least one radiating element to the ground plane at a first location on the ground plane, the first location on the ground plane being separated from the feed connection by a third distance and a galvanic connection connecting the at least one radiating element and the feed plate, there being a capacitive and a galvanic connection between the feed plate and the at least one radiating element.

There is further provided in accordance with a further preferred embodiment of the present invention an antenna having multiple radiating bands including a ground plane, a feed plate extending generally parallel to and being spaced from the ground plane by a first distance and having a feed connection between the feed plate and the ground plane, at least one radiating element extending generally parallel to and being spaced from the feed plate by a second distance and at least one galvanic connector connecting the at least one radiating element at a first location on the at least one radiating element to the ground plane at a first location on the ground plane, the first location on the ground plane being separated from the feed connection by a third distance, the feed plate at least partially overlapping portions of at least two conductive arms defined by the at least one radiating element and the at least one galvanic connector.

There is additionally provided in accordance with an additional preferred embodiment of the present invention an antenna having multiple radiating bands including a ground plane, a feed plate extending generally parallel to and being spaced from the ground plane by a first distance and having a feed connection between said feed plate and said ground plane, at least one radiating element extending generally parallel to and being spaced from the feed plate by a second distance, and at least one galvanic connector connecting the feed plate at a first location on the feed plate to the ground plane at a first location on the ground plane, said first location on the ground plane being separated from the feed connection by a third distance, the first, second and third distances being selected to achieve desired impedance matching of the feed.

In accordance with a preferred embodiment of the present invention the antenna also includes a dielectric support platform underlying the at least one radiating element. Preferably, the first, second and third distances are selected to achieve desired impedance matching of the feed plate.

In accordance with another preferred embodiment of the present invention the feed plate includes a capacitive feed plate. Preferably, the feed connection extends from a feed contact pad which is electrically insulated from the ground plane. Additionally or alternatively, the at least one radiating element is formed with at least one slot.

In accordance with a further preferred embodiment of the present invention the at least one galvanic connector extends from a ground contact pad which is galvanically connected to the ground plane.

BRIEF DESCRIPTION OF THE DRAWINGS

The present invention will be understood and appreciated more fully from the following detailed description, taken in conjunction with the drawings in which:

FIG. 1 is a simplified schematic illustration of an antenna constructed and operative in accordance with a preferred embodiment of the present invention;

FIGS. 2A, 2B, 2C and 2D are respective simplified pictorial, top view and first and second sectional view illustrations of one embodiment of an antenna constructed and operative in accordance with the present invention, the sectional illustrations being taken along respective section lines IIC-IIC and IID-IID in FIG. 2B;

FIGS. 4A, 4B, 4C and 4D are respective simplified pictorial, top view and first and second sectional view illustrations of another embodiment of an antenna constructed and operative in accordance with the present invention, the sectional illustrations being taken along respective section lines IVC-IVC and IVD-IVD in FIG. 4B.

DETAILED DESCRIPTION OF PREFERRED EMBODIMENTS

Figure 3A:
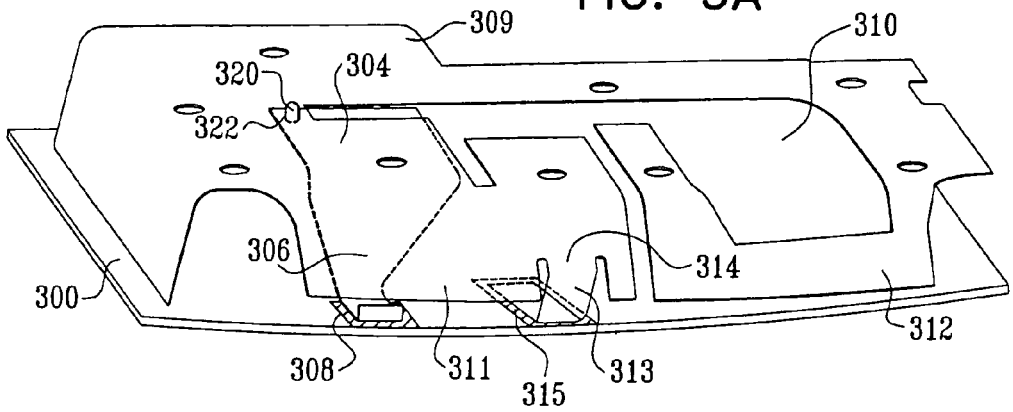
FIGS. 3A, 3B, 3C and 3D are respective simplified pictorial, top view and first and second sectional view illustrations of a preferred embodiment of an antenna constructed and operative in accordance with the present invention, the sectional illustrations being taken along respective section lines IIIC-IIIC and IIID-IIID in FIG. 3B.

Reference is now made to FIG. 1, which is a schematic illustration of an antenna constructed and operative in accordance with a preferred embodiment of the present invention. FIG. 1 illustrates an antenna which preferably has multiple radiating bands.

As seen in FIG. 1, the antenna preferably comprises a ground plane 100 having an aperture 102 formed therein. A feed plate 104 preferably extends generally parallel to and is spaced from the ground plane 100 by a first distance D1 and has a feed connection 106 extending through the aperture 102 in ground plane 100.

A radiating element 110 extends generally parallel to and is spaced from the feed plate 104 by a second distance D2. A galvanic connector 112 is connected at a first end thereof to radiating element 110 at a location 114 on the radiating element 110 and at a second end thereof to the ground plane 100 at a location 116 on the ground plane 100. Location 116 on the ground plane 100 is separated from the feed connection 106 by a third distance D3.

In accordance with a preferred embodiment of the present invention, the first, second and third distances D1, D2 and D3 and the area of the feed plate 104 are selected to achieve desired impedance matching of the feed to the antenna. The third distance D3 preferably allows the feed plate 104 to feed radiating element 110 at a location corresponding to an impedance substantially greater than 50 Ohm at least one band. Typical radiating bands of the antenna of FIG. 1 include, but are not limited to, the following bands: GSM, AMPS, GPS, CDMA, PCS, UMTS, WCDMA and DCS.

Reference is now made to FIGS. 2A, 2B, 2C and 2D, which are respective simplified pictorial, top view and first and second sectional view illustrations of one embodiment of an antenna constructed and operative in accordance with the present invention.

As seen in FIGS. 2A, 2B, 2C and 2D, the antenna preferably comprises a ground plane 200. A generally rectangular capacitive feed plate 204 preferably extends generally parallel to and is spaced from the ground plane 200 by a first distance D11 and has a feed connection 206, preferably extending diagonally with respect to ground plane 200 and to feed plate 204 from a feed contact pad 208 which is electrically insulated from ground plane 200.

A radiating element 209 extends generally parallel to and is spaced from the capacitive feed plate 204 by a second distance D12. The radiating element 209 preferably comprises a rectangular plate which is formed with a longitudinal slot 210 along a central portion thereof. Slot 210 communicates with a transversely extending slot 211.

A galvanic connector 212, preferably extending diagonally with respect to ground plane 200 and to capacitive feed plate 204, is connected at a first end thereof to the radiating element 209 at a location 214 on the radiating element 209 and at a second end thereof to the ground plane 200 at a ground contact pad 215 at a location 216 on the ground plane 200. Ground contact pad 215 is galvanically connected to the ground plane 200. The location 216 on the ground plane 200 is separated from the feed connection 206 at the ground plane 200 by a third distance D13.

In accordance with a preferred embodiment of the present invention, the first, second and third distances D11, D12 and D13 and the area of the feed plate 204 are selected to achieve desired impedance matching of the feed to the antenna. The third distance D13 preferably allows the capacitive feed plate 204 to feed radiating element 209 at a location corresponding to an impedance substantially greater than 50 Ohm at least one band. Typical radiating bands of the antenna of FIGS. 2A-2D include but are not limited to the following bands: GSM, AMPS, GPS, CDMA, PCS, UMTS, WCDMA and DCS.

Figure 3B:
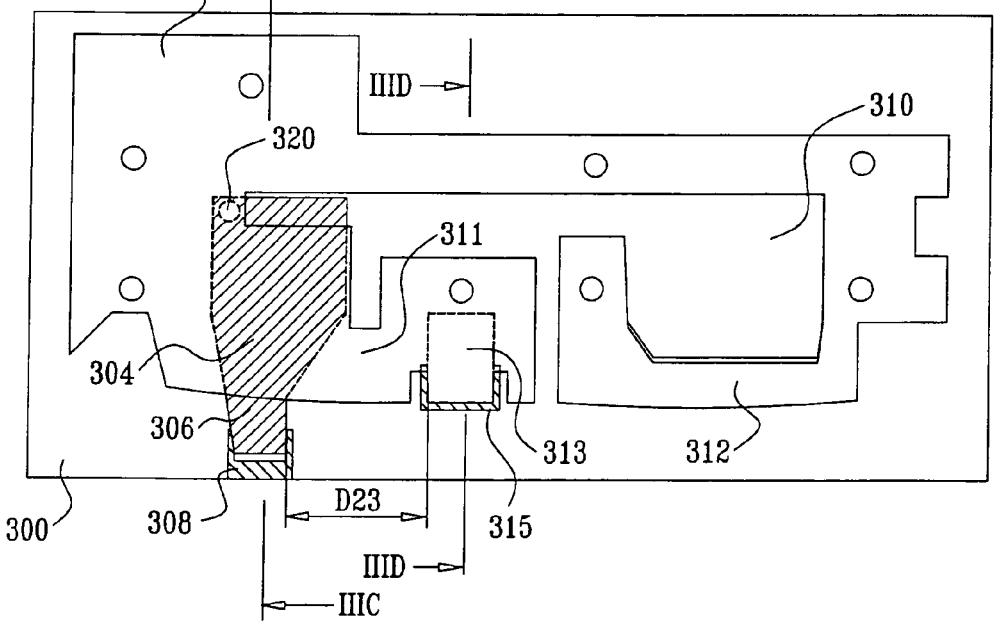
Figure 3C:
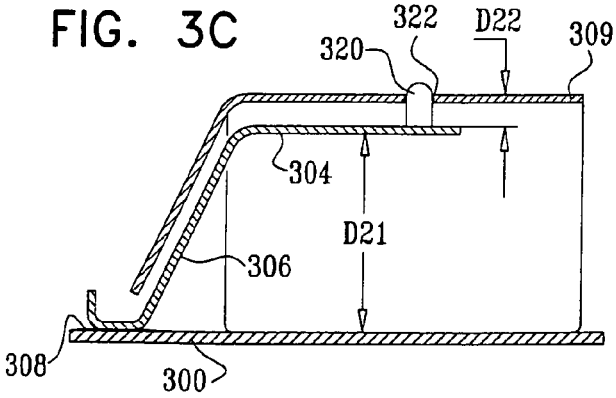
Figure 3D:
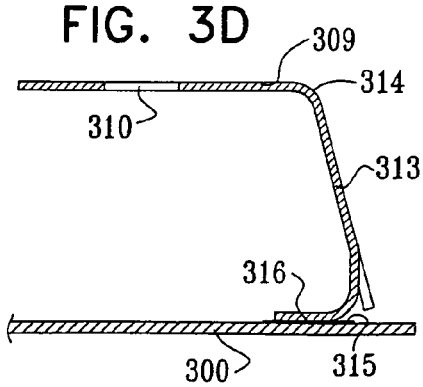

Reference is now made to FIGS. 3A, 3B, 3C and 3D, which are respective simplified pictorial, top view and first and second sectional view illustrations of a preferred embodiment of an antenna constructed and operative in accordance with the present invention.

As seen in FIGS. 3A, 3B, 3C and 3D, the antenna preferably comprises a ground plane 300. A capacitive feed plate 304 preferably extends generally parallel to and is spaced from the ground plane 300 by a first distance D21 and has a feed connection 306, preferably extending diagonally with respect to ground plane 300 and to feed plate 304 from a feed contact pad 308 which is electrically insulated from ground plane 300.

A radiating element 309 extends generally parallel to and is spaced from the capacitive feed plate 304 by a second distance D22. The radiating element 309 preferably comprises a generally rectangular plate which is curved at some of its edges and is formed with a multidirectional slot 310 having various dimensions and which defines at least two conductive arms, designated generally by reference numerals 311 and 312.

A galvanic connector 313, preferably extending diagonally with respect to ground plane 300 and to capacitive feed plate 304, is connected at a first end thereof to the radiating element 309 at a location 314 on the radiating element 309 and at a second end thereof to the ground plane 300 at a ground contact pad 315 at a location 316 on the ground plane 300. Ground contact pad 315 is galvanically connected to the ground plane 300. The location 316 on the ground plane 300 is separated from the feed connection 306 at the ground plane 300 by a third distance D23.

In accordance with a preferred embodiment of the present invention, the first, second and third distances D21, D22 and D23 and the area of the feed plate 304 are selected to achieve desired impedance matching of the feed to the antenna. Typical radiating bands of the antenna of FIGS. 3A-3D include but are not limited to the following bands: GSM, AMPS, GPS, CDMA, PCS, UMTS, WCDMA and DCS.

It is a particular feature of the embodiment of FIGS. 3A-3D that a galvanic connection 320 is provided between the feed plate 304 and the radiating element 309 at a location 322 thereon, providing both a capacitive and a galvanic connection between the feed plate and the radiating element. This structure provides substantially enhanced bandwidth and impedance matching as well as enhanced radiating efficiency in the relatively low frequencies.

Reference is now made to FIGS. 4A, 4B, 4C and 4D, which are respective simplified pictorial, top view and first and second sectional view illustrations of one embodiment of an antenna constructed and operative in accordance with the present invention.

As seen in FIGS. 4A, 4B, 4C and 4D, the antenna preferably comprises a ground plane 400. A generally rectangular capacitive feed plate 404 preferably extends generally parallel to and is spaced from the ground plane 400 by a first distance D31 and has a feed connection 406, preferably extending diagonally with respect to ground plane 400 and to feed plate 404 from a feed contact pad 408 which is electrically insulated from ground plane 400.

A radiating element 409 extends generally parallel to and is spaced from the capacitive feed plate 404 by a second distance D32. The radiating element 409 preferably comprises a rectangular plate which is formed with a pair of longitudinal slots 410 along a central portion thereof. Slots 410 communicate with a transversely extending slot 411.

One or more galvanic connectors 412, preferably extending diagonally with respect to ground plane 400 and to capacitive feed plate 404, are connected at first ends thereof to the radiating element 409 at locations 414 on the radiating element 409 and at second ends thereof to the ground plane 400 at one or more ground contact pads 415 at locations 416 on the ground plane 400. Ground contact pads 415 are galvanically connected to the ground plane 400. One or more of locations 416 on the ground plane 400 are separated from the feed connection 406 at the ground plane 400 by a third distance D33.

In accordance with a preferred embodiment of the present invention, the first, second and third distances D31, D32 and D33 and the area of the feed plate 404 are selected to achieve desired impedance matching of the feed to the antenna. Typical radiating bands of the antenna of FIGS. 4A-4D include but are not limited to the following bands: GSM, AMPS, GPS, CDMA, PCS, UMTS, WCDMA and DCS.

The embodiment of FIGS. 4A-4D is characterized by the provision of a dielectric support platform 420 which underlies and supports the radiating element 409. It is a particular feature of the embodiment of FIGS. 4A-4D that the feed plate 404 at least partially overlaps portions of at least two conductive arms 422 and 424 defined by the radiating element 409 and its ground connections 412.

Figure 5A:
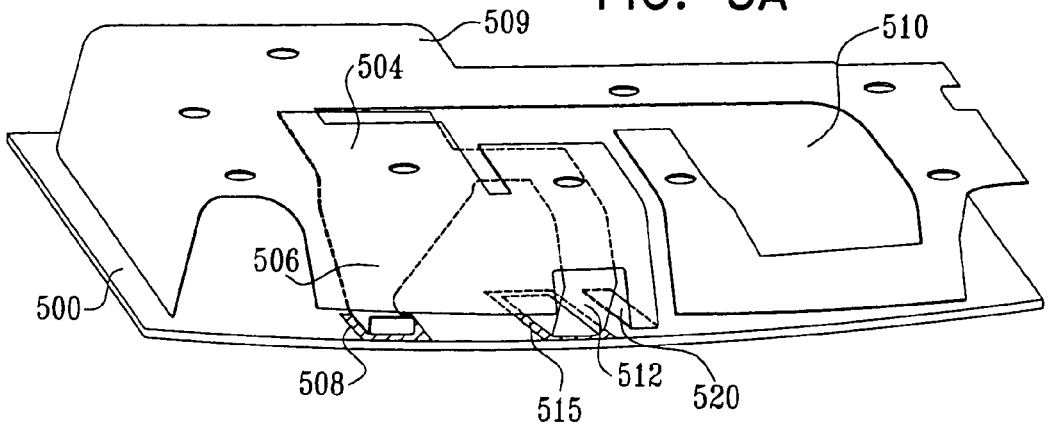
FIGS. 5A, 5B, 5C and 5D are respective simplified pictorial, top view and first and second sectional view illustrations of yet another embodiment of an antenna constructed and operative in accordance with the present invention, the sectional illustrations being taken along respective section lines VC-VC and VD-VD in FIG. 5B.
Figure 5B:
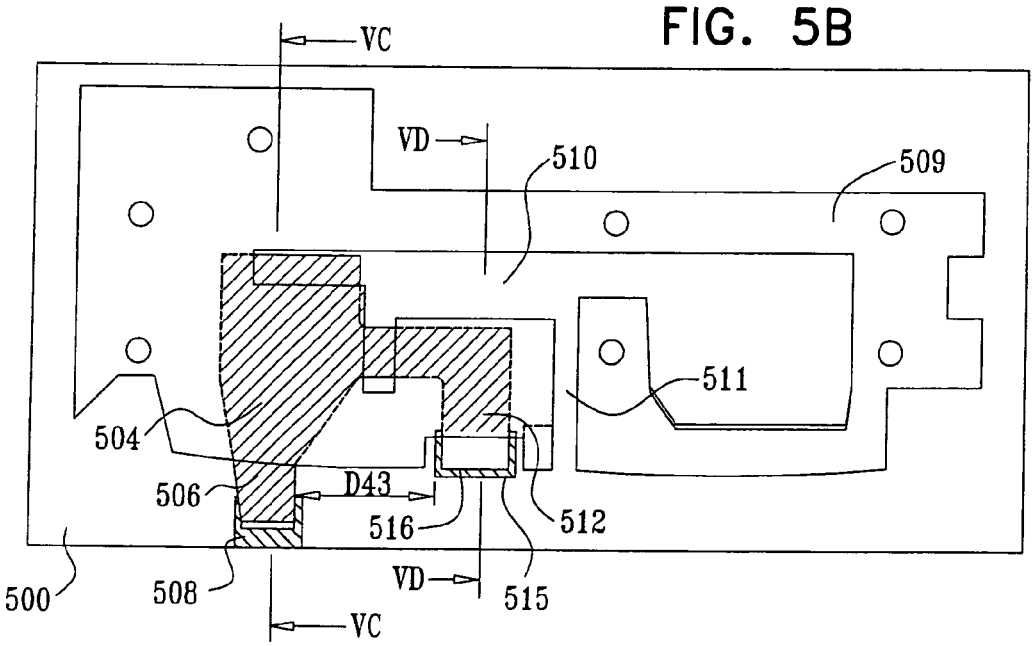
Figure 5C:
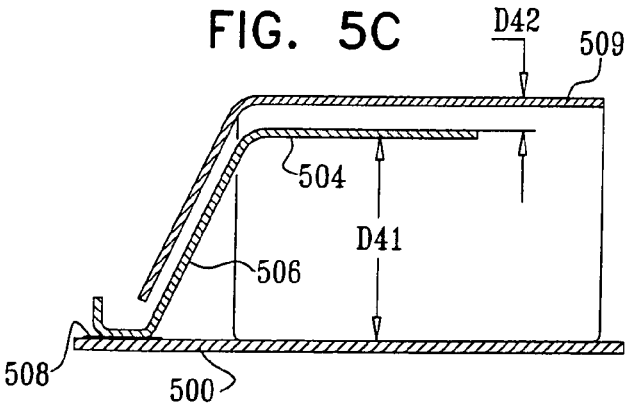
Figure 5D:
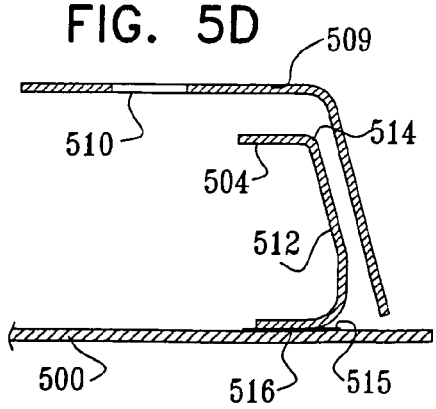

Reference is now made to FIGS. 5A, 5B, 5C and 5D, which are respective simplified pictorial, top view and first and second sectional view illustrations of one embodiment of an antenna constructed and operative in accordance with the present invention.

As seen in FIGS. 5A, 5B, 5C and 5D, the antenna preferably comprises a ground plane 500. A capacitive feed plate 504 preferably extends generally parallel to and is spaced from the ground plane 500 by a first distance D41 and has a feed connection 506, preferably extending diagonally with respect to ground plane 500 and to feed plate 504 from a feed contact pad 508 which is electrically insulated from ground plane 500.

A radiating element 509 extends generally parallel to and is spaced from the capacitive feed plate 504 by a second distance D42. The radiating element 509 preferably comprises a rectangular plate which is formed with a longitudinal slot 510 along a central portion thereof. Slot 510 communicates with a transversely extending slot 511.

A galvanic connector 512, preferably extending diagonally with respect to ground plane 500 and to capacitive feed plate 504, connected at a first end thereof to the capacitive feed plate 504 at a location 514 on the capacitive feed plate 504 and at a second end thereof to the ground plane 500 at a ground contact pad 515 at a location 516 on the ground plane 500. Ground contact pad 515 is galvanically connected to the ground plane 500. The location 516 on the ground plane 500 is separated from the feed connection 506 at the ground plane 500 by a third distance D43.

A second galvanic connector 520, which preferably extends diagonally with respect to ground plane 500 and connects radiating element 509 with the ground plane 500.

In accordance with a preferred embodiment of the present invention, the first, second and third distances D41, D42 and D43 and the area of the feed plate 504 are selected to achieve desired impedance matching of the feed to the antenna. Typical radiating bands of the antenna of FIGS. 5A-5D include but are not limited to the following bands: GSM, AMPS, GPS, CDMA, PCS, UMTS, WCDMA and DCS.

A particular feature of the antenna of FIGS. 5A to 5D that the feed plate 504 provides both capacitive and inductive coupling for feeding the radiating element 509.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

The invention claimed is:

1. An antenna having multiple radiating bands, comprising:

a ground plane;

a feed plate extending generally parallel to and being spaced from said ground plane by a first distance and having a feed connection extending between said feed plate and said ground plane;

at least one radiating element extending generally parallel to and being spaced from said feed plate by a second distance, and at least one galvanic connector connecting said at least one radiating element at a first location on said at least one radiating element to said ground plane at a first location on said ground plane, said first location on said ground plane being separated from said feed connection by a third distance, said first, second and third distances being selected to achieve desired impedance matching of said feed plate, said feed plate feeding said at least one radiating element at a location corresponding to an impedance substantially greater than 50 Ohm at least one band, and said feed plate being substantially smaller than said at least one radiating element.

2. An antenna according to claim 1, wherein said ground plane has an aperture formed therein, and said feed connection extends through said aperture.

3. An antenna according to claim 1, and wherein said feed plate comprises a capacitive feed plate.

4. An antenna according to claim 1, and wherein said feed connection extends from a feed contact pad which is electrically insulated from said ground plane.

5. An antenna according to claim 1, and wherein said at least one radiating element is formed with at least one slot.

6. An antenna according to claim 1, and wherein said at least one galvanic connector extends from a ground contact pad which is galvanically connected to said ground plane.

7. An antenna having multiple radiating bands comprising:

a ground plane;

a feed plate extending generally parallel to and being spaced from said ground plane by a first distance and having a feed connection extending between said feed plate and said ground plane;

at least one radiating element extending generally parallel to and being spaced from said feed plate by a second distance;

at least one galvanic connector connecting said at least one radiating element at a first location on said at least one radiating element to said ground plane at a first location on said ground plane, said first location on said ground plane being separated from said feed connection by a third distance; and at least one galvanic connection connecting said at least one radiating element and said feed plate, there being a capacitive and a galvanic connection between said feed plate and said at least one radiating element, said feed plate feeding said at least one radiating element at a location corresponding to an impedance substantially greater than 50 Ohm at least one band, and said feed plate being substantially smaller than said at least one radiating element.

8. An antenna according to claim 7, and wherein said first, second and third distances are selected to achieve desired impedance matching of said feed plate.

9. An antenna according to claim 7, and wherein said feed plate comprises a capacitive feed plate.

10. An antenna according to claim 7, and wherein said feed connection extends from a feed contact pad which is electrically insulated from said ground plane.

11. An antenna according to claim 7, and wherein said at least one radiating element is formed with at least one slot.

12. An antenna according to claim 7, and wherein said at least one galvanic connector extends from a ground plane contact pad which is galvanically connected to said ground plane.

13. An antenna having multiple radiating bands comprising:

a ground plane;

a feed plate extending generally parallel to and being spaced from said ground plane by a first distance and having a feed connection between said feed plate and said ground plane;

at least one radiating element extending generally parallel to and being spaced from said feed plate by a second distance; and at least one galvanic connector connecting said at least one radiating element at a first location on said at least one radiating element to said ground plane at a first location on said ground plane, said first location on said ground plane being separated from said feed connection by a third distance, said feed plate at least partially overlapping portions of at least two conductive arms defined by said at least one radiating element and said at least one galvanic connector, said feed plate feeding said at least one radiating element at a location corresponding to an impedance substantially greater than 50 Ohm at least one band, and said feed plate being substantially smaller than said at least one radiating element.

14. An antenna according to claim 13, and also comprising a dielectric support platform underlying said at least one radiating element.

15. An antenna according to claim 13, and wherein said first, second and third distances are selected to achieve desired impedance matching of said feed plate.

16. An antenna according to claim 13, and wherein said feed plate comprises a capacitive feed plate.

17. An antenna according to claim 13, and wherein said feed connection extends from a feed contact pad which is electrically insulated from said ground plane.

18. An antenna according to claim 13, and wherein said at least one radiating element is formed with at least one slot.

19. An antenna according to claim 13, and wherein said at least one galvanic connector extends from a ground contact pad which is galvanically connected to said ground plane.

20. An antenna having multiple radiating bands comprising:

a ground plane;

a feed plate extending generally parallel to and being spaced from said ground plane by a first distance and having a feed connection between said feed plate and said ground plane;

at least one radiating element extending generally parallel to and being spaced from said feed plate by a second distance, and at least one galvanic connector connecting said feed plate at a first location on said feed plate to said ground plane at a first location on said ground plane, said first location on said ground plane being separated from said feed connection by a third distance, said first, second and third distances being selected to achieve desired impedance matching of said feed plate, said feed plate providing inductive and capacitive coupling for feeding said at least one radiating element, said feed plate feeding said at least one radiating element at a location corresponding to an impedance substantially greater than 50 Ohm at least one band, and said feed plate being substantially smaller than said at least one radiating element.

21. An antenna according to claim 20 and also comprising at least one galvanic connector connecting said at least one radiating element to said ground plane.

22. An antenna according to claim 20, and wherein said first, second and third distances are selected to achieve desired impedance matching of said feed plate.

23. An antenna according to claim 20, and wherein said feed plate comprises a capacitive feed plate.

24. An antenna according to claim 20, and wherein said feed connection extends from a feed contact pad which is electrically insulated from said ground plane.

25. An antenna according to claim 20, and wherein said at least one radiating element is formed with at least one slot.

26. An antenna according to claim 20, and wherein said at least one galvanic connector extends from a ground contact pad which is galvanically connected to said ground plane.

* * * * *